United States Patent [19]

Pask

[11] 4,335,527

[45] Jun. 22, 1982

[54] DISPOSABLE BOOTS

[76] Inventor: James B. Pask, 2812 Bree Hill Rd., Oakton, Va. 22124

[21] Appl. No.: 119,203

[22] Filed: Feb. 7, 1980

[51] Int. Cl.[3] ..... A43B 3/16

[52] U.S. Cl. ..... 36/7.1 R

[58] Field of Search ..... 36/7.1, 7.3, 1, 10

[56] References Cited

U.S. PATENT DOCUMENTS

| | | | |
|---|---|---|---|
| 3,283,422 | 11/1966 | Nygard | 36/1 |
| 3,337,770 | 8/1967 | Saraceni et al. | 36/7.1 |
| 3,402,323 | 9/1968 | Longstreth | 36/7.1 |

*Primary Examiner*—Patrick D. Lawson

[57] ABSTRACT

This invention provides for disposable boots constructed of heat-sealed flexible film with lines of perforation to create an economical and practical panel and hence, pair of disposable foot apparel which has a sole, foot portion and leg segment. To a sheet of heat-sealable film material, a series of heat seal lines and perforation lines are applied to a pre-set pattern resulting in a roll of continuous panels comprising pairs of disposable boots. A number of additional embodiments may be incorporated to achieve additional insulating, fashion, strength and comfort qualities.

10 Claims, 17 Drawing Figures

DISPOSABLE BOOTS

CROSS-REFERENCES TO RELATED APPLICATIONS

This application is related to co-pending application, Ser. No. 092278, filed Nov. 8, 1979, and entitled "DISPOSABLE BOOT" of common inventorship.

BACKGROUND OF THE INVENTION

This invention pertains to footwear of a disposable nature—but in the form of a boot. The prior art, as provided under U.S. Pat. Nos. 3,283,422 and 3,402,323 provide such advantages as being of a disposable nature but protect only the foot of the wearer or are of a nature that they are applicable to a certain style of shoe, i.e. ladies dress shoes. However, there is no provision for covering the calf or leg portion of the wearer. There are a variety of inventions preceeding the above cited patents that provide certain protection to the wearer. U.S. Pat. No. 3,387,180 is a shoe cover with static electricity discharge means; U.S. Pat. No. 2,449,936 is a foot wrapper; U.S. Pat. No. 2,924,029 is a plastic shoe which is described as a overshoe—refolded and kept; U.S. Pat. No. 2,986,823 is described as an overshoe—being of a disposable nature for various shapes and sizes of shoes and heights of heels; U.S. Pat. No. 3,422,550 which is described as a disposable shoe cover—a surgical type being of non-porous thermoplastic elastomer; U.S. Pat. No. 3,898,750 which is described as a universal size disposable shoe cover; and U.S. Pat. No. 4,083,124 which is described as a protective shoe covering. Even though these inventions offer selective advantages to a variety of wearers, none provide a single method of providing protection to the leg or calf portion of the wearer in a readily detachable form where the method of construction is efficient or the use versatile.

SUMMARY OF THE INVENTION

This invention relates to a convenient, economical, functional and practical form of boot construction well-suited to temporarily protect the feet of the wearer yet inexpensive enough to dispose of after a short period of time or use. In addition, this invention incorporates properties and variations that permit use as outer footwear or solely as footwear; it provides for a flexible pattern which when altered, permits adaptability to a multiplicity of sizes and shapes; it provides for a variety of applications which produce insulating, comfort and fashion properties; it provides cost-efficient alternatives to construction and packaging—by the roll or by a group of separated panels—each comprising a pair of boots. This invention provides for the application of simple manufacturing processes (like those used in the manufacture of trash, storage, etc., bags) to heat-sealable film or other comparable material resulting in a practical disposable boot having a foot segment as well as a segment extending up the calf portion of the leg. This invention provides a single film element incorporating a series of heat seals and perforations which, when separated result in a material-efficient, economical, functional and practical apparel with no waste of film materials or construction processes.

The disposable boot, being light-weight and compact, lends itself to economical and convenient packaging and dispensing—by the pair(s) or by the continuous roll—where they can be readily stored at home, office, in a vehicle, at the plant, in a purse or in a pocket. This product eliminates the need for storing or transporting wet and/or soiled footwear. The disposable boot may be readily removed by the wearer upon arrival at a destination; stored quickly, re-used for return trip or thrown away.

Changing times and conditions have generated the need for disposable footwear which provides temporary protection to both the leg and foot of the wearer. The household produces costly, multi-shoe and/or boot wardrobes (street shoes and boots, dress shoes and boots, tennis and jogging shoes, hunting boots) which are regularly being out-grown or outdated. Conventional outer-footwear is neither economical or sufficiently versatile or durable to be adaptable to the varied foot apparel of one wearer. Moreover, this invention is adaptable to use in environments or conditions (e.g., hospitals, laboratories, etc.) where sanitary conditions are desired or under conditions (e.g. nuclear facilities, etc.) where the wearer must avoid being contaminated or spreading contamination. Additionally, this invention may be useful where temporary and inexpensive surgical protection is desired such as over casts, bandages or the like.

While the wearer may select one size as an overboot, by selecting a smaller size, the wearer may achieve a size which may be worn solely as a boot (not outer footwear) which, with refinements set forth herein, may provide comfort and protection.

BRIEF DESCRIPTION OF THE DRAWING

FIG. 10 illustrates three modifications to the disposable boot design and construction.

FIGS. 12 & 13 illustrate a pair of disposable boots separated from the panel and standing upright and in a perspective view as in FIG. 13.

FIG. 15 illustrates the application of rounding corners of perpendicular lines.

DESCRIPTION OF THE PREFERRED EMBODIMENTS

Figure 1:
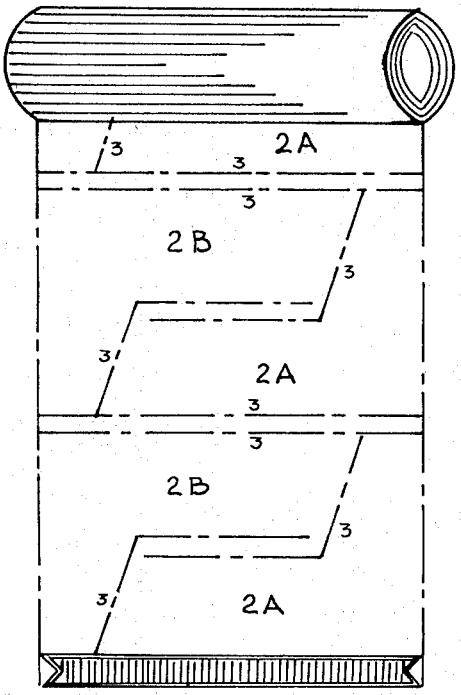
FIG. 1 illustrates a roll of heat-sealable flexible film (1) made of one sheet of material folded along the outside edge and heat-sealed along the opposite outside edge or formed of continuous tubing material. The design is shown by the pattern imposed on the film of a series of heat-seal lines resulting in the formation of a series of panels of a pair of disposable boots (2A & 2B). Heat-seal lines (3) are provided along the toe, top of foot, sole and both lengths of calf portion of leg. Heat-seals would not be required along the outside edges of the film where the roll has been formed by a fold or by continuous tubing. The top portion of the leg segment is not head-sealed thus permitting means of inserting foot.

As shown in FIG. 1 of the illustrations, a disposable boot may be constructed from a continuous single sheet or preferably from a continuous seamless tube 1 of a heat-sealable film material. Such a suitable film material may be made from a resin composition, or equivalent, which is comprised of appropriate amounts of polyethylene and polyvinyl acrylate copolymer or polyvinyl acetate or other materials having comparable properties which produce flexibility and elasticity of the invention.

Other resin compositions may be used to make heat sealable film material having the variety of physical properties desired to obtain the numerous variations and adaptations of this invention.

Heat-sealable plastic film material may be of a thickness ranging from 0.5 mils to 10.0 mils but more preferably in the range of from 1.0 to 6.0 mils.

For use in such places as hospitals, laboratories or the like where conductivity is a desired property, carbon black may be added to the composition of the flexible film material. If a surface friction quality is desired to reduce sliding on wet surfaces, a resin material containing polyvinyl acrylate or equivalent may be used. The composition of the flexible film may be further varied to achieve a bio-degradable substance.

Figure 2:
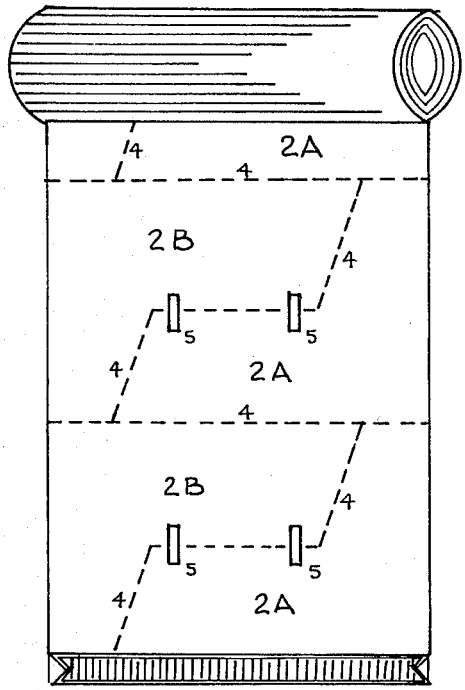
FIG. 2 illustrates the same roll as in FIG. 1 but with the application of a series of perforations (4) forming a series of panels of a pair of disposable boots (2A & 2B). Additionally are illustrated the application of self-grip tabs (5) applied at top and bottom of perforation forming the front portion of the leg. These tabs are fastened to only one side of the perforation with the counter-part tab fastened to the opposite side of the companion disposable boot.
Figure 3:
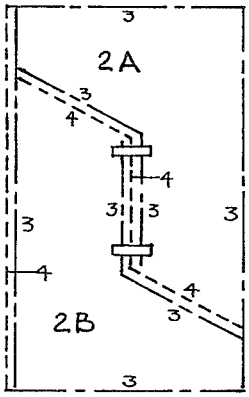
FIG. 3 illustrates one panel of a pair of disposable boots separated from the continuous roll of heat-sealable film and shows the applications described and illustrated in FIGS. 1 and 2.
Figure 6:
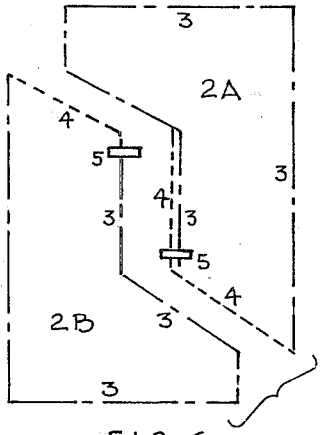
FIG. 6 illustrates one panel of a pair of disposable boots as in FIG. 3 with each boot separated along the lines of perforation (4). Heat-seal lines (3) create the individual disposable boot. Upon separation, the self-grip tabs, as described in FIG. 2, extend beyond the front edge of the boot thus permitting the fitting of the leg portion to the wearer.

The flexible film material is formed into a tube 1 by a conventional tuber or made of a single sheet of film which is folded approximately in half and head sealed along the common outside edge. The length of continuous material is fed through apparatus comparable of those providing continuous and repetitive patterns, seals and applications. As shown in FIGS. 1 and 2, this process produces heat seal lines 3 and lines of perforation 4. The lines of perforation lie adjacent to the heat seal lines thus creating the pattern of the pair of disposable boots within a singular panel which panels are formed repetitively in a continuous roll or in a single per-pair-panel. Each panel as in FIG. 3 can thusly be separated from the continuous roll and in turn, each panel can be separated into two identical halves 2A and 2B—the halves becoming the pair of disposable boots as shown in FIG. 6. Should a single, continuous tube 1 of flexible film be preferred over the folded sheet, the need for a heat seal line along the edge parallel and opposite the fold is eliminated.

Figure 4:
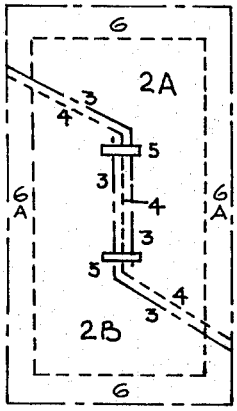
FIGS. 4 & 5 illustrate one panel of a pair of disposable boots as in FIG. 3 with the reservation of a perimeter area reserved for a gusset (6), if desired, unfolded as in FIG. 4 and formed to the interior of the panel as in FIG. 5. If the gusset application is designed, this design provides that when the pair of boots are separated from the panel, each disposable boot is of a smaller size but when the foot is inserted the gusset formed along the bottom of the boot and along the back of the leg portion expand outwardly to receive the foot.
Figure 5:
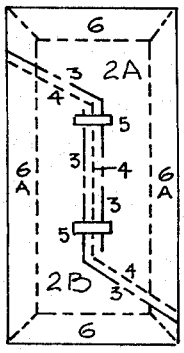
Figure 7:
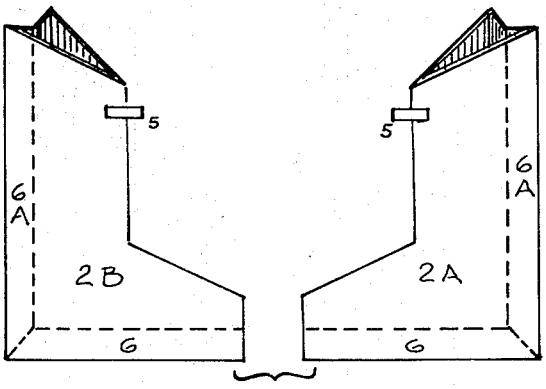
FIG. 7 illustrates a pair of disposable boots subsequent to separation from the panel and standing upright. The top of the leg portion, being formed by perforation rather than by heat seal provides the opening for inserting the foot and leg. Also shown in the perimeter gusset described in FIGS. 4 & 5.
Figure 8:
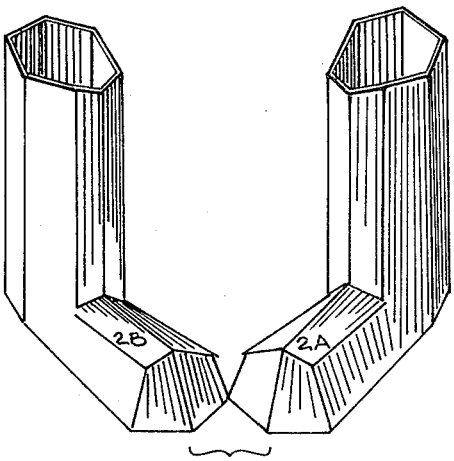
FIG. 8 illustrates a perspective view of a pair of disposable boots opened to receive foot and leg.

To achieve a more compact yet expandable disposable boot, gussets 6 may be formed into the tube 1 of film along both side edges of the film by the same apparatus as forms the tube. When the boot is separated for wearing as in FIGS. 7 and 8, the expansion of this portion of the disposable boot results in a pre-formed sole. To achieve an additional expansion segment, the individual heat sealed and perforated panels may be separated from the continuous roll and processed again through the same apparatus used to form gusset 6 and an additional gusset 6A is formed resulting in an expandable area running along the rear of the leg portion. Expansion of gusset 6 and gusset 6A may form one continuous area of expansion extending from the toe area of the wearer, along the sole areas, around the heel and extending to the top portion of the leg as shown in FIGS. 4 and 5.

If preferred, to permit fitting of the upper leg portion of the disposable boot around the leg of the wearer, self-grip adhesive fastening means 5, such as "VELCRO" or the like, may be applied on both outside surfaces of the film at one or more points along the top and bottom of the perforation forming the front portion of the leg segment of the disposable boot. The tabs 5 are secured to the film material along only one side of said line of perforation with the counterpart tab secured to the opposite side of the companion boot. When the panel of boots is separated to result in the pair as in FIG. 6, each boot possesses a self-grip tab located at the top front portion of the leg; hence, one portion of each tab is secured to the film with the other portion extending beyond, which creates the tab and which enables the wearer to fit the leg portion of the disposable boot around the leg of the wearer and secure the tab against the receiving tab surface. To remove, the tabs are separated intact, for ready re-use. It should be understood that there are a variety of means to securing and fitting the disposable boot other than the self-grip tab and that such is only intended as an example of a functional yet re-usuable embodiment.

This invention is versatile in that by varying the width of the continuous tube 1 or sheet 1 of film, the resulting disposable boot may be larger or smaller, longer or shorter, and/or wider or narrower. For example, the wider the tube or sheet 1, the larger and/or longer the boot and the narrower the tube or sheet 1, the smaller and/or shorter the boot.

The ratio of the sole segment (i.e. the bottom surface of the foot) to the leg segment (i.e. the vertical surface extending from the heal of the sole and upwards) of the disposable boot should be one where the leg segment is greater than one-half the length of the length of the sole segment.

Figure 11:
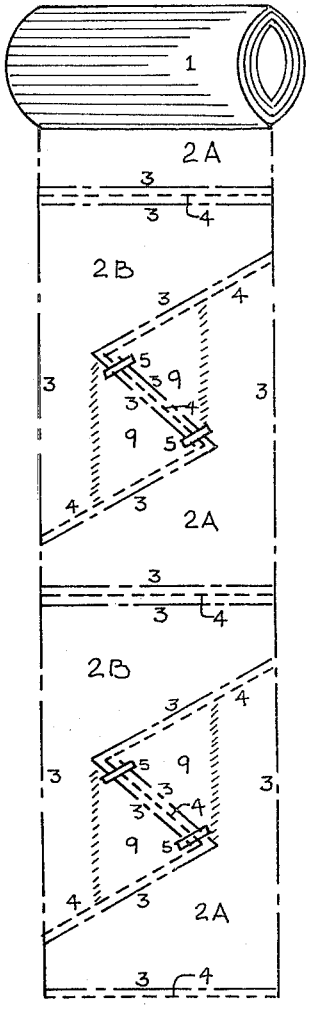
FIG. 11 illustrates a design modification to the pattern imprint shown in FIGS. 1, 2 & 9. This alternative design provides a wider opening by enlarging the front portion of the upper leg (9) for insertion of the foot. Once placed on the foot and leg of the wearer, the oversized opening is wrapped across the leg and secured by the self-grip tabs.
Figure 12:
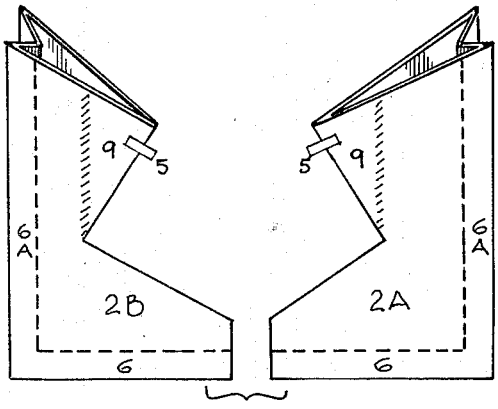
Figure 13:
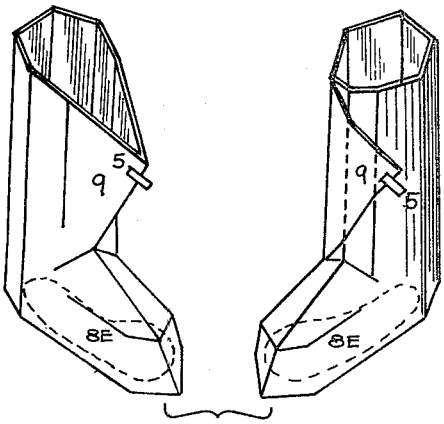
FIG. 13 shows insertion of the sole into the base of the boots. The modifications described above and as illustrated in FIGS. 10A, 10B & 10C provide properties which permit the disposable boots to be utilized over footwear or without footwear.
Figure 14:
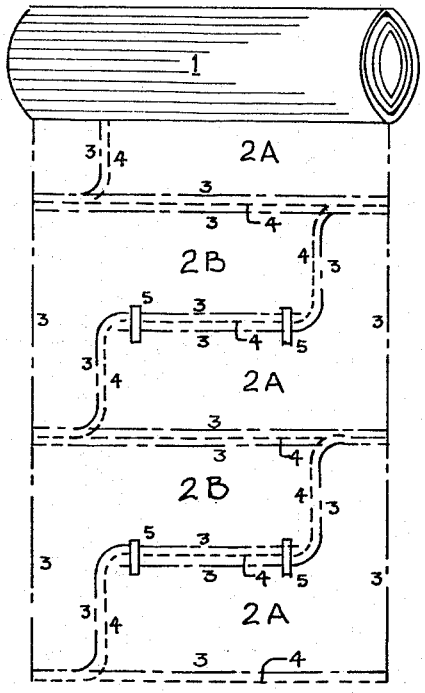
FIGS. 14 & 15 illustrate a design modification to the pattern imprint shown in FIGS. 1, 2, 9 & 11. This alternative provides for a pattern resulting from the application of perpendicular lines of heat-seal and or perforations.
Figure 15:
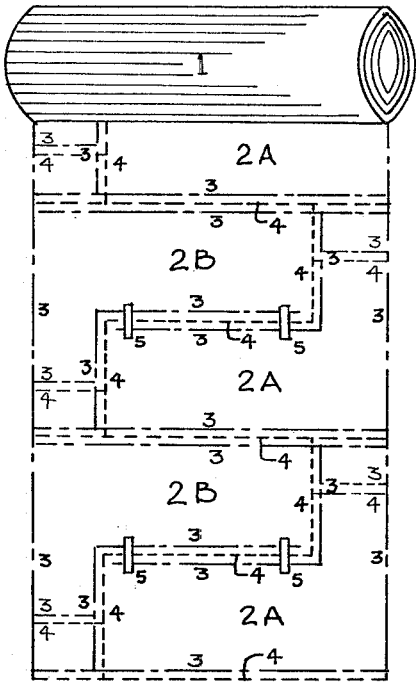

As shown in FIGS. 1, 2, 11, 14 and 15, the pattern lines formed by the heat seal 3 and perforation 4 and creating the desired configuration of disposable boots may be a combination of parallel lines, perpendicular lines as in FIG. 14, angled lines as in FIG. 11, or curved lines as in FIG. 15—any or all of which may be formed by conventional apparatus. FIGS. 12 and 13 show the angled line variation; upon separation of the panel from the roll or package it is separated into to two individual boots and expanded to receive the foot and leg of the wearer.

Once the heat seal lines, lines of perforation and self-grip tabs are applied to the film material, the panel of a pair of disposable boots may be either separated from the continuous roll or other desired packaging media. Each panel is then separated along the lines of perforation and thence, individually opened or expaned to receive the leg of the wearer. Upon separation of the panel, inasmuch as a seam will result along the front portion of the disposable boot between the heat seal line and perforation, the wearer may readily turn the boot(s) inside out so that the seam appears along the inside of the boot.

Added properties which can be introduced into this invention include but are not limited to the following:

Construction of heat sealable flexible film in a variety of colors or of a clear material. By turning inside out the wearer has the option of two colors.

Figure 9:
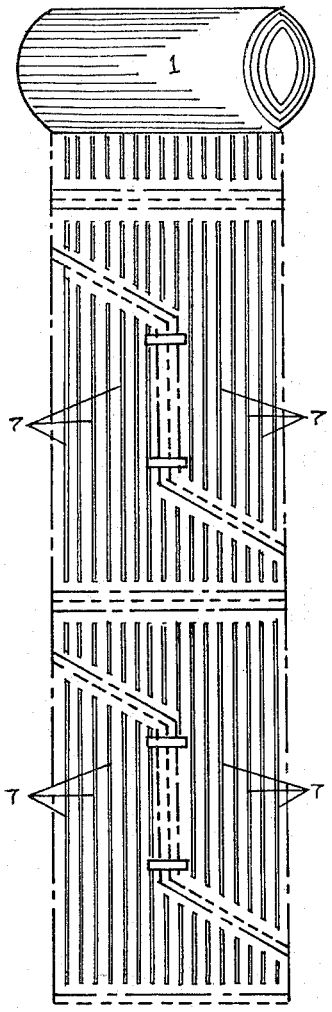
FIG. 9 illustrates a variation of the manufacture of the roll of disposable boot panels as first illustrated in FIGS. 1 & 2. This variation permits the roll width of heat-sealable film material to be narrower thus resulting in such benefits as more compact packaging.
Figure 10A:
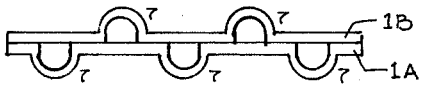
FIG. 10A illustrates two (or more if desired), plys of heat-sealable film (7) formed over air spaces (or pockets) (7) which run parallel to the length of each panel as shown in FIG. 9. This modification adds to the upright stability of each boot as well as desired insulating and durability properties.

Two or more plys of heat sealable film may be joined together over air space(s) as in FIG. 10A thus creating air pockets within the film which pockets may run in lengths 7 parallel to the length of each panel as shown in FIG. 9 or in a mass of small bubbles. This refinement adds stability to each disposable boot as well as desired insulating capability.

Figure 10B:
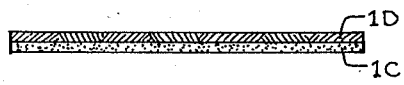
FIG. 10B illustrates a layer (or series of layers) of heat-sealable film (1C) with a layer of fabric, paper of similar porous material (1D) bonded to the heat-sealable film. The result is a heat-sealable film surface (1C) facing the outside of the boot and the fabric, paper or similar porous material (1D) facing the inside of the boot.

A layer, or series of layers, of heat sealable film may be bonded to a porous, textured material such as paper, fabric or similar substance as in FIG. 10B. The result is a heat-sealable film exterior surface and the porous or similar material surface on the interior. This refinement provides added comfort qualities including the capability of absorbing moisture and/or sweating which originates within the boot while being worn.

Figure 10C:
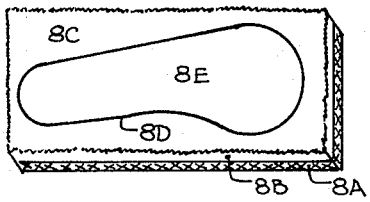
FIG. 10C illustrates an inner sole provided separately—each being made by applying a desired thickness of foam rubber (8B) bonded to a desired thickness of cardboard or similar material (8A). The wearer can either trace its shoe outline on the foam finished surface (8C) and cut out with scissors or the sole outline could be pre-perforated for separation along line (8D) of the sole (8E) from the panel.

An inner sole may be desired and provided separately with each pair or series of pairs of disposable boots. This invention provides for a sole constructed of a desired thickness of foam rubber or similar material 8B, bonded to a desired thickness of cardboard or similar substance 8A. As shown in FIG. 10C, on the resulting plane of the bonded materials 8A and 8B, the wearer may trace the outlines of his feet or foot apparel to be worn, cut out with conventional scissors and inserted within the sole portion of the disposable boot as shown in FIG. 13; or the pattern of a pre-determined pair of soles may be pre-constructed by lines of perforation 8A to permit ready separation from the inner sole plane 8C and insertion into the disposable boots as in FIG. 13; or the inner soles 8E may be preconstructed for packaging with the disposable boots.

Two or more plys of heat sealable file may be bonded together over one of a multiplicity of "stays" which run parallel to the length of each disposable boot. This will enhance the upright stability property of the disposable boot.

It should be understood that the disposable boot can be made in a variety of repetitive patterns on a continuous roll permitting removal one by one or by the pair. Further, the flexibility of the pattern design permits a variety of sizes to be made on each continuous roll.

I claim:

1. A pair of disposable boots manufactured in the form of heat-sealable flexible film, comprising:

a. two layers of said film;

b. heat-seal lines and perforations adjacent thereto defining the perimeter of a pair of boots with each boot having a foot segment and an integral leg encircling segment which extends above the ankle of the wearer, and having an opening to receive the foot and leg of the wearer; and wherein said film is flexible permitting the disposable boot to be adapted to cover a variety of footwear of varying sizes and at the same time covering clothing apparel which extends down the leg of the wearer or which disposable boot can be adapted to be worn solely as footwear; at least three additional heat-seal lines and perforations within said perimeter forming a pre-determined configuration of disposable boots which lines may be a combination of parallel lines, perpendicular lines, angled lines and curved lines producing disposable boots generally fitting the contour and form of both the foot and leg of the wearer in one integral element; and wherein the height of said leg encircling segment is greater than one-half the length of the sole segment.

2. The disposable boots of claim 1 wherein a self-grip fastening means is attached to the leg segment of the boot.

3. The disposable boots of claim 2, wherein said self-grip fastening means comprises a receiving fastening surface.

4. The disposable boots of claim 3, wherein said fastening means is attached to one said length of said leg segment adapting the leg segment of the disposable boot for fitting around the leg of the wearer and secured against said receiving fastening means.

5. The disposable boots of claim 1 wherein said film has a thickness ranging from 0.5 mils to 10.0 mils but more preferably in the range of 1.0 to 6.0 mils.

6. The disposable boots of claim 1 manufactured in the form of heat-sealable plastic film in a single panel, comprising:

a. a perimeter area folded into a gusset; and b. three heat-sealably defined straight lines which are in spaced-apart pairs and separated by perforations therebetween, said straight lines comprising a middle line, which is longitudinally and centrally disposed within said panel, and a pair of oblique lines which are connected to the ends of said middle line and extend to the longer sides of said plane.

7. A disposable boot of claim 1 wherein multiple plys of heat-sealable flexible plastic film material are formed over air spaces (or foreign material) resulting in film material having air pockets (or stays) of varying shapes and dimensions thus producing structural, durability and insulating properties in the film material.

8. A disposable boot of claim 1 wherein is provided a means of bonding a layer or ply of fabric, paper or similar porous material to the heat-sealable flexible film material thus producing moisture-absorption, structural, durability and insulating properties in the film material from which the disposable boots are formed.

9. A disposable boot of claim 1 wherein is provided a separately constructed inner sole such sole being constructed of a combination of cardboard, paper or the like and/or foam rubber or like cushion material and whereby said sole may be adapted by the wearer whether by cutting or separating from a pre-constructed panel and inserted into the sole portion of the disposable boot.

10. The disposable boots of claim 1 which contain a pair of fasteners, one end of each fastener being attached to one said boot and transversely disposed to said middle line.

* * * * *